US005307121A

United States Patent [19]

Johnson

[11] Patent Number: 5,307,121

[45] Date of Patent: Apr. 26, 1994

[54] BI-FUNCTIONAL CHARGE NEUTRALIZER FOR ELECTROSTATOGRAPHIC COPIER/PRINTER

[75] Inventor: Kevin M. Johnson, Rochester, N.Y.

[73] Assignee: Eastman Kodak Company, Rochester, N.Y.

[21] Appl. No.: 980,083

[22] Filed: Nov. 23, 1992

[51] Int. Cl.[5] ..... G03G 15/02

[52] U.S. Cl. ..... 355/219; 355/221; 355/222; 355/276; 361/212; 361/214

[58] Field of Search ..... 355/219, 221, 222, 226, 355/315, 271, 274, 276; 361/212, 213, 214, 220, 221, 222

[56] References Cited

U.S. PATENT DOCUMENTS 4,087,170 5/1978 Sawaoka et al. ..... 355/219 X
4,985,730 1/1991 Ohba et al. ..... 355/219 X
5,063,399 11/1991 Zaman et al. .
5,140,379 8/1992 Johnson .

FOREIGN PATENT DOCUMENTS 52-67334 3/1977 Japan ..... 355/221

*Primary Examiner*—A. T. Grimley
*Assistant Examiner*—Shuk Y. Lee
*Attorney, Agent, or Firm*—Norman Rushefsky

[57] ABSTRACT

An electrostatographic copier/printer, preferably of the type in which toner images are thermally transferred from an image-recording element to an image receiver sheet, includes an electrostatic charge generator, preferably an AC corona charger, which is positioned to neutralize residual charge on the image-receiving member following the transfer of a toner image thereto, as well as to neutralize the charge on untransferred toner prior to removal of such toner from the recording element.

17 Claims, 2 Drawing Sheets

BI-FUNCTIONAL CHARGE NEUTRALIZER FOR ELECTROSTATOGRAPHIC COPIER/PRINTER

BACKGROUND OF THE INVENTION

The present invention relates to the field of electrostatographic image recording, such as electrophotography and electrography. More particularly, it relates to improvements in apparatus and methods for neutralizing electrostatic charges retained on image-receiving members and image-recording elements as a result of the electrostatographic image-forming process.

In the electrostatographic image recording process, an electrostatic charge image is formed on the photoconductive or dielectric surface of an image-recording element. The charge image is rendered visible by the application of pigmented electroscopic particles commonly known as "toner". To enable re-use of the image-recording element, the toner image is transferred to image-receiver member, typically a sheet of paper, which is brought into contact with the toner-bearing recording element at an image-transfer station. At this station, it is common to subject the receiver sheet to an electric field tending to attract the toner from the recording element to the receiver. Alternatively, toner transfer may be effected by the application of heat and/or pressure to the receiver sheet. Of course, any untransferred or residual toner on the recording element must be removed or cleaned from the recording element prior to recycling the recording element through the image-forming process.

In many electrostatographic processes, it is advantageous to neutralize any electrostatic charges remaining on untransferred toner particles prior to the aforementioned cleaning step. Such charge neutralization is typically effected by an AC corona charger which operates to alternately deposit negative and positive ions on the residual toner, the effect being that the net charge is driven to zero.

Once toner has been successfully transferred to a receiver sheet, it is common to fuse the toner to the receiver by the application of heat and/or pressure. Usually, the receiver sheet exits the fusing process with a net charge, whereby the sheet has a propensity for being attracted to other sheets or working surfaces. The net charge on the receiver sheet is due to the residual charge of the toner on its surface, as well as the charge that may have been applied to the sheet to effect toner transfer. The effect of toner charge is magnified in non-electrostatic transfer processes (e.g., thermal and/or pressure transfer processes) where the toner never comes in contact with an oppositely charged receiver sheet. The problem of static attraction of the receiver sheet is often handled by static discharge brushes and the like. The effectiveness of such devices is dependent on the conductivity of the receiver and toner. Overhead transparencies are usually the most difficult to discharge due to their insulative properties.

In conventional electrostatographic image recording apparatus, the above noted charge-neutralizing functions are provided by separate and distinct charge neutralizers, one being used to discharge the charge on the untransferred toner, and the other being used to discharge the residual charge on the receiver sheet following image transfer. The need for two charge neutralizers adds expense and complexity to the image-recording apparatus.

SUMMARY OF THE INVENTION

In light of the foregoing discussion, an object of this invention is to provide a single apparatus which is capable of providing both of the aforedescribed charge neutralizing functions substantially simultaneously.

The bi-functional charge neutralizing apparatus of the invention is adapted for use in an electrostatographic image recording apparatus of the type which includes a re-usable image recording element on which electrostatically charged marking particles are image-wise deposited to form transferrable images, and an image transfer station at which such transferrable images on the image recording element are transferred to an image receiving member to enable re-use of the recording element. The apparatus of the invention comprises an electrostatic charge neutralizer located proximate the transfer station and adapted to simultaneously deposit charge on both the image-receiving member and the recording element. In the case where the electrostatographic image recording apparatus comprises a drum-shaped recording element which, together with a similarly shaped transfer drum, defines an image transfer nip at which toner images are transferred, under the influence of heat and pressure, from the recording element to an image receiver sheet passing through the nip, the charge neutralizing apparatus of the invention is located downstream of this image transfer nip and preferably comprises an AC corona charger which is adapted to spray charge on both the recording element and the receiver sheet as they separate following image transfer.

The invention and its advantages will be better understood from the ensuing detailed description of preferred embodiments, reference being made to the accompanying drawings.

DETAILED DESCRIPTION OF PREFERRED EMBODIMENTS

Figure 1:
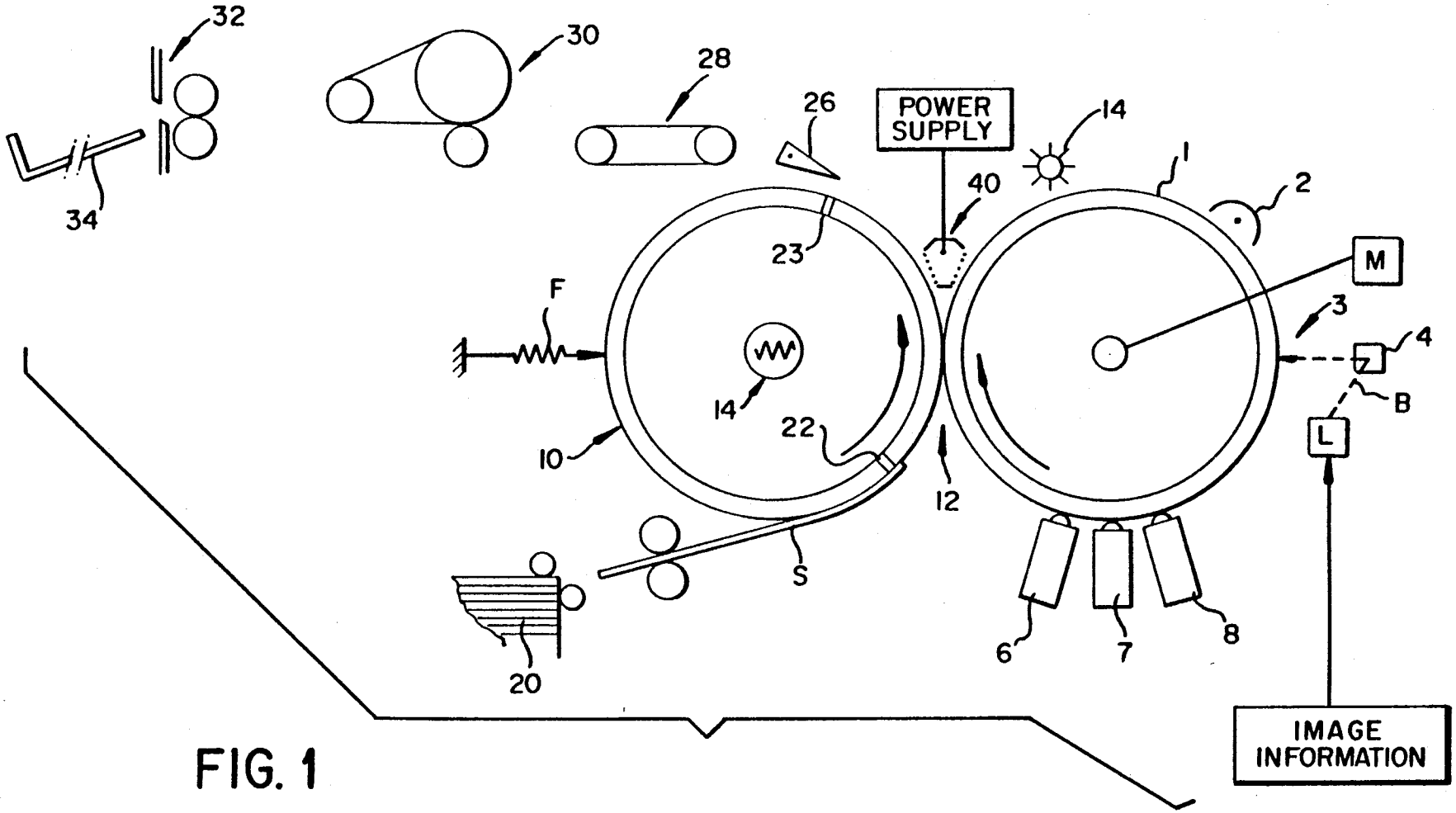
FIG. 1 is a schematic illustration of an electrophotographic copier/printer embodying the apparatus of the invention.

Referring now to the drawings, FIG. 1 is a schematic illustration of an electrophotographic color printer embodying the bi-functional charge neutralizing apparatus of the invention. The general type of printing apparatus is disclosed, for example, in my commonly assigned U.S. patent application Ser. No. 07/688,004, filed Apr. 4, 1991 and entitled POSITION CONTROL APPARATUS FOR TRANSFER DRUM IN ELECTROSTATOGRAPHIC PRINTER/COPIER, the disclosure of which is hereby incorporated herein by reference. Most of the apparatus shown is conventional, as is its operation. The image recording element, for example, comprises a conventional photoconductive drum 1 which is rotated at a constant angular velocity in a clockwise direction (as viewed) by a stepping motor M. Positioned about the drum periphery are the various processing stations which act collectively to carry out the well known electrophotographic image-forming process. A corona charging station 2 functions to uniformly charge the photoconductive surface of drum 1.

This uniformly charged surface is then imagewise exposed at an exposure station 3 to form a developable electrostatic charge pattern. The exposure station may comprise, for example, a laser diode L having an output beam B which is intensity modulated with image information to be recorded. Beam B is repeatedly scanned across the width of the photoconductive drum, parallel to the drum's axis of rotation, by a rotating polygon 4 to selectively dissipate the uniform charge and thereby the developable charge pattern. In a full color image recording system, a series of color separation images are formed in this manner, and each image is rendered visible as it passes one of a plurality of development stations 6, 7 and 8 which applies a suitably colored toner (e.g., cyan, magenta or yellow) to the charge pattern. In a well-known manner, the toner particles are triboelectrically charged to a polarity such as to be attracted to that portion of the charge image that is to be developed. The toner images so produced are then transferred, seriatim and in registration, to an image-receiver sheet S carried on the surface of a transfer drum 10. Such transfer is effected at an image transfer station 12 defined by the nip between drums 1 and 10. Transfer drum 10 is thermally conductive, preferably being made of aluminum, and is internally heated by a quartz lamp 14 or the like. Means are provided for urging the transfer drum into engagement with the photoconductive drum, as indicated by the spring force F. The receiver sheet may comprise, for example, a sheet of paper having a thermoplastic coating which is adapted to receive the toner image on the recording element when heat and pressure are applied by the transfer drum at the image transfer station. After image transfer, the photoconductive drum is cleansed of untransferred toner particles by a rotating fur brush 14 or the like, and the recording element is recycled through the image-forming process.

Image receiver sheets S are fed from a sheet supply 20 toward the outer surface of the transfer drum. As each sheet approaches the transfer drum, it is secured to the drum surface by a series of vacuum ports 22,23, which secure the leading and trailing edges of the sheet to the drum surface. Rotation of the transfer drum operates to advance the receiver sheet through the transfer station where the receiver sheet receives the developed toner images from the photoconductive drum. Assuming drum 1 bears three color separation toner images, such as cyan, magenta and yellow, the transfer drum makes three revolutions through the transfer station so that the receiver sheet receives the three images, one atop the other and in registration. Following image transfer, the receiver is stripped from the transfer drum by a stripping mechanism 26. The receiver sheet is then pushed by further rotation of the transfer drum onto a sheet transport 28 which transport the sheet to a toner fixing device 30 and then to a cutter 32. After the sheet has been cut to desired sizes, the resulting prints are deposited in a tray 34.

In the apparatus described above, it will be noted that image transfer to the receiver sheets is effected without the assistance of any electrostatic forces, as are commonly used in similar copiers and printers to attract toner particles from the recording element to the receiver, and/or to electrostatically detack the receiver from the recording element surface to facilitate separation of the receiver from the recording element. As noted, toner transfer is effected in the FIG. 1 apparatus by contacting the image with a thermoplastic surface (i.e., the thermoplastic surface of the receiver sheet) which, when heated, becomes more receptive to the toner than the photoconductive surface of drum 1, and detack is effected by physically stripping the receiver from the transfer drum. Thus, the electrostatic charges on the toner particles applied by development stations 6, 7 and 8 are not substantially neutralized by any opposite charges or oppositely charged surfaces that might ordinarily be used to transfer the toner image to the receiver sheet, or to detack the receiver sheet from the recording element. In such an apparatus, therefore, it is highly desirable to provide some means for neutralize the charge on the receiver sheet following image transfer, as well as to neutralize the charge on the untransferred toner particles carried by the recording element to facilitate toner removal by the cleaning station 14.

Figure 2:
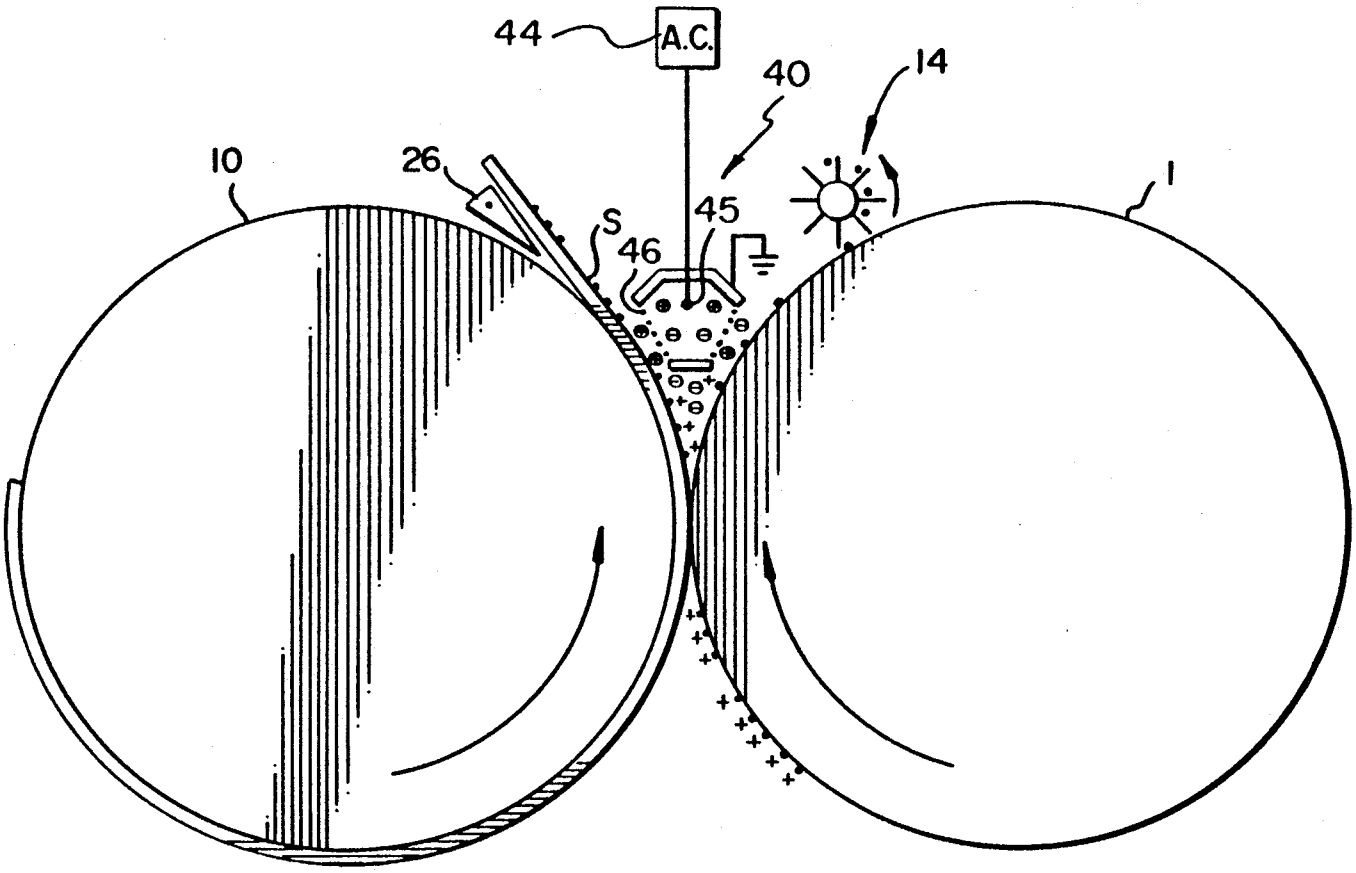
FIG. 2 is an enlarged view of the image transfer station of the FIG. 1 apparatus which better illustrates the bi-functional charge neutralizing apparatus of the present invention.

Now in accordance with the present invention, there is provided a bi-functional charge neutralizer 40 which operates to provide both of the above-mentioned charge-neutralizing functions substantially simultaneously. Referring to FIG. 2, charge neutralizer 40 preferably comprises an AC corona charger positioned downstream of the transfer nip 12 between drums 1 and 10. Charger 40 is energized by an AC power source 44 which is directly connected to its corona discharge wire 45. When energized, charger 40 operates in a well known manner to alternately produce both positive and negative ions. Those ions of a polarity opposite the triboelectric charge on the toner serve to neutralize the charge on the untransferred toner, as well as to neutralize the residual charge on the receiver sheet. Preferably, charger 40 comprises a control grid 46 which is electrically grounded to assure that little or no charge remains on the untransferred toner and receiver sheet as they exit the transfer station.

In some cases, it may be preferable to apply different, DC-offset biases to the two grids, the receiver-facing grid and the PC-facing grid, so as to more efficiently compensate for the differing charges transferred and left as residual, respectively. Given that the fraction of toner transferred is relatively constant, the PC-facing grid voltage can be operated as a constant fraction of the receiver-facing grid voltage (e.g., 1/10th). It is not unusual to require receiver-facing grid voltages of −800 volts in the current embodiment, and a corona voltage of 8–10 KV peak. Voltages are determined by the charge-to-mass ratio of the toner and the average density (or mass) transferred to the receiver, as well as ambient conditions.

The invention has been described with particular reference to preferred embodiments. It will be appreciated, however, that modifications and variations can be made without departing from the true spirit of the invention. Such modifications and variations are intended to fall within the scope of the appended claims.

What is claimed is:

1. In an electrostatographic image recording apparatus of a type which includes an image recording element on which electrostatically charged marking particles are imagewise deposited to form a transferrable image, and a transfer mechanism for transferring such transferrable image on the image recording element to an image receiving member, the improvement comprising:

charge-neutralizing means for simultaneously reducing (i) any residual electrostatic charge on the image receiving member following image transfer, and (ii) reducing any electrostatic attraction between the image recording element and any marking particles remaining thereon following image transfer.

2. The apparatus as defined by claim 1 wherein said charge-neutralizing means comprises an electrostatic discharge device which is positioned to apply electrostatic charges to said image receiving member and to said image recording element simultaneously.

3. The apparatus as defined by claim 2 wherein said discharge device comprises a corona charger.

4. The apparatus as defined by claim 3 wherein said corona charger is energized by an alternating current source.

5. The apparatus as defined by claim 4 wherein said corona charger comprises an electrically grounded grid for controlling levels of charge applied to both the image recording element and the image receiving member.

6. In an electrostatographic image recording apparatus of a type which includes an image recording element on which electrostatically charged marking particles are imagewise deposited to form a transferrable image, and a transfer station at which a heated image-receiving member is urged into contact with said image recording member to effect transfer of the transferrable image on the image recording element to the image receiving member, the improvement comprising:

charge-neutralizing means for simultaneously reducing (i) any electrostatic charge on the image receiving member following image transfer, and (ii) reducing any electrostatic attraction between the image recording element and any marking particles remaining thereon following image transfer.

7. The apparatus as defined by claim 6 wherein said charge-neutralizing means comprises an electrostatic discharge device which is positioned to apply electrostatic charges to said image receiving member and to said image recording element simultaneously.

8. The apparatus as defined by claim 7 wherein said discharge device comprises a corona charger.

9. The apparatus as defined by claim 8 wherein said corona charger is energized by an alternating current source.

10. The apparatus as defined by claim 9 wherein said corona charger comprises an electrically grounded grid for controlling levels of charge applied to both the image recording element and the image receiving member.

11. In an electrostatographic image recording apparatus of a type which includes a moving image recording element on which electrostatically charged marking particles are imagewise deposited to form a transferable image, and a transfer mechanism for transferring such transferable image on the image recording element to a moving image receiving member, the transfer mechanism including means for defining a nip with the recording element and means for moving the receiving member through said nip, the improvement comprising:

discharge means, including an electrostatic discharge element located proximate said nip, for causing said electrostatic discharge element to create ions for both (i) reducing any residual electrostatic charge on the image receiving member following image transfer, and (ii) reducing any electrostatic attraction between the image recording element and any marking particles remaining thereon following image transfer.

12. The apparatus of claim 11 wherein said discharge means includes an alternating current source for energizing said electrostatic discharge element.

13. The apparatus of claim 12 wherein said discharge means includes an electrically grounded grid for controlling levels of charge applied to both the image recording element and the image receiving member.

14. The apparatus of claim 11 wherein said electrostatic discharge element is a wire and wherein first and second electrical grid means are associated with said wire and wherein said first electrical grid means controls a flow of ions generated by said wire to a surface of said image receiver member to which said marking particles are transferred and the second electrical grid means controls a flow of ions generated by said wire to a surface of the image recording element after separation of the image receiver member from the image recording element.

15. The apparatus of claim 14 and including means for heating the image receiving member when the member is in said nip.

16. The apparatus of claim 2 and wherein the electrostatic discharge device is positioned to simultaneously apply electrostatic to a surface of said image recording element that receives the transferable image and to a surface of said image receiving member that includes marking particles thereon following image transfer.

17. The apparatus of claim 7 and wherein the electrostatic discharge device is positioned to simultaneously apply electrostatic charge to a surface of said image recording element that receives the transferable image and to a surface of said image receiving member that includes marking particles thereon following image transfer.

* * * * *